US009421408B2

(12) United States Patent
Massola

(10) Patent No.: US 9,421,408 B2
(45) Date of Patent: Aug. 23, 2016

(54) INFLATABLE STRUCTURE FOR PHYSICAL EXERCISE IN WATER

(71) Applicant: Mattia Massola, Levanto (IT)

(72) Inventor: Mattia Massola, Levanto (IT)

( * ) Notice: Subject to any disclaimer, the term of this patent is extended or adjusted under 35 U.S.C. 154(b) by 205 days.

(21) Appl. No.: 14/259,401

(22) Filed: Apr. 23, 2014

(65) Prior Publication Data

US 2014/0323273 A1 Oct. 30, 2014

(30) Foreign Application Priority Data

Apr. 26, 2013 (IT) ..... MI2013A0691

(51) Int. Cl.
*A63B 9/00* (2006.01)
*A63B 69/00* (2006.01)

(52) U.S. Cl.
CPC ..... *A63B 9/00* (2013.01); *A63B 69/0048* (2013.01); *A63B 2225/60* (2013.01); *A63B 2225/62* (2013.01)

(58) Field of Classification Search
CPC ..... A63B 9/00; A63B 2009/002; A63B 2009/004; A63B 2009/006; A63B 2009/008; A63B 69/0048; A63B 2225/60; A63B 2225/605
See application file for complete search history.

(56) References Cited

U.S. PATENT DOCUMENTS 5,540,178 A * 7/1996 Damron ..... B63B 27/14 114/362
5,810,695 A * 9/1998 Sass ..... A63B 5/11 441/37
6,322,454 B1 * 11/2001 Gordon ..... A63B 69/0048 472/134
6,551,215 B1 * 4/2003 Gordon ..... A63B 69/0048 472/134
2002/0010053 A1 1/2002 Peterson
2008/0293546 A1 11/2008 Moy et al.
2012/0231686 A1 9/2012 Parr

FOREIGN PATENT DOCUMENTS

CA 2325844 5/2002

OTHER PUBLICATIONS

Italian Search Report; Munich, Germany; Apr. 26, 2013 for application No. ITMI20130691; 7 pages.

* cited by examiner

*Primary Examiner* — Oren Ginsberg
(74) *Attorney, Agent, or Firm* — Thomas Horstemeyer, LLP

(57) ABSTRACT

An inflatable structure for physical exercise in water is described.
The inflatable structure is able to be associated to a support wall of said inflatable structure, the support wall extending along a plane substantially orthogonal to a reference plane corresponding substantially to a stretch of water.
The inflatable structure comprises means for accessing the inflatable structure, which are configured to allow a person the access from the water to the inflatable structure, said access means being operatively connected to a lower portion of the inflatable structure, said access means extending along a plane substantially orthogonal to the reference plane.

10 Claims, 6 Drawing Sheets

INFLATABLE STRUCTURE FOR PHYSICAL EXERCISE IN WATER

CROSS-REFERENCE TO RELATED APPLICATION(S)

This application claims priority to Italian Application No. MI2013A000691, filed Apr. 26, 2013, which is herein incorporated by reference in its entirety.

TECHNOLOGICAL BACKGROUND OF THE INVENTION

1. Field of Application

The present invention relates to inflatable equipment for physical exercise, and particularly an inflatable structure for physical exercise in water.

2. Description of the Prior Art

Equipment for physical exercise in water are known, such as, for example, an inflatable structure or island laid on the stretch of water of a swimming-pool.

An inflatable structure or island extends upwardly in a more or less even manner (typically, a pyramid or a cusp) so as to define climbing walls on one hand, and a ramp-like descending wall on the other hand. The physical exercise that a user may perform on such inflatable structure or island is typically an upwardly climbing and the subsequent descent to the water through the ramp.

An inflatable structure or island described above has the drawback that is does not have an easy access from the water, both in terms of convenience, and in terms of safety.

In fact, in order to access the structure, it is necessary that a person moves upwardly one foot after another to reach the structure base and climbs on it for the upwardly climbing step. This may be quite troublesome for people who are not very tall, and, moreover, it may cause, due to the wet surface of the inflatable structure (at least at the base), an accidental fall into the water of the person who is trying and climbing, which may involve damages to the same person or to other people near to the inflatable structure.

Object of the present invention is to devise and provide an inflatable structure for physical exercise in water that allows at least partially obviating the drawbacks set forth above with reference to the prior art.

SUMMARY OF THE INVENTION

Such an object is achieved by an inflatable structure for physical exercise in water in accordance with claim 1.

Preferred embodiments of the inflatable structure for physical exercise in water are defined in the dependent claims.

BRIEF DESCRIPTION OF THE DRAWINGS

Further characteristics and advantages of the inflatable structure according to the invention will be apparent from the description set forth below of preferred implementation examples, given by way of illustrative, non-limiting example, with reference to the appended Figures, in which.

DETAILED DESCRIPTION

Figure 1A:
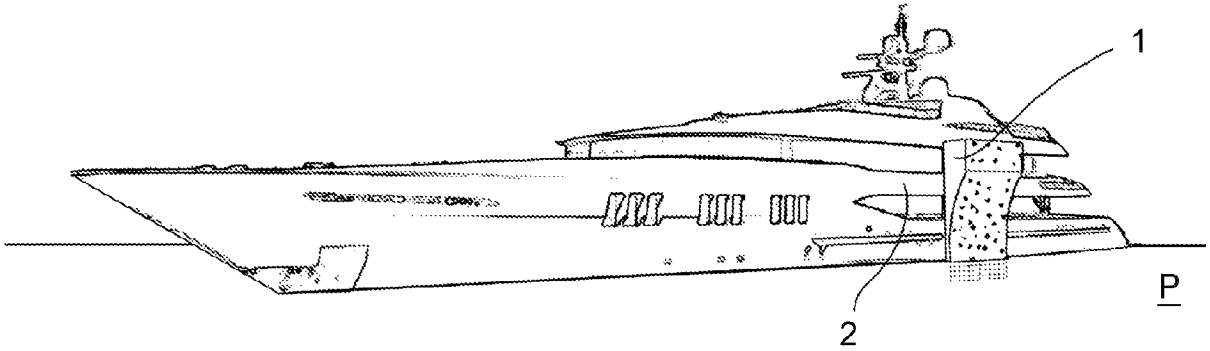
FIGS. 1*a* and 1*b* respectively illustrate a ship and a ship portion in which an inflatable structure for physical exercise in water according to an embodiment of the invention is installed.

With reference to the above-mentioned Figures, an inflatable structure for physical exercise in water, herein below referred to also simply as inflatable structure, has been indicated with 1, according to the invention on the whole.

It is pointed out that, in the Figures, the same or like elements are indicated by the same numerical and alphanumerical references.

To the aims of the present description, by physical exercise in water is meant any activities which a person can perform on the inflatable structure without necessarily a safety harness, since a possible fall will be reduced by water. Examples of such physical exercise can be an upwardly climbing, a downwardly climbing, dives, and so on.

The inflatable structure 1 is able to be associated to a support wall 2 of said inflatable structure 1.

The support wall 2 extends along a plane substantially orthogonal to a reference plane P substantially corresponding to a stretch of water, for example, the stretch of water on which part of the support wall 2 is immersed.

In this regard, the support wall 2 comprises a first portion 3 extending upwardly from the reference plane P, i.e., surfacing from the stretch of water, and a second portion 4 extending downwardly from the reference plane P, i.e., immersing in the stretch of water.

The support wall 2 comprises, on top of the first portion 3 of such support wall 2, members for securing the inflatable structure 1 (not shown in the Figures).

To the aims of the present description, the support wall 2 of the inflatable structure can be any walls facing a stretch of water that is sufficiently deep to ensure a person safety in the case of a fall from the inflatable structure, such as, for example, a wall of a pier or a harbor dock or a bathhouse, the edge wall of a swimming-pool, the wall of a ship hull, and so on.

Figure 1B:
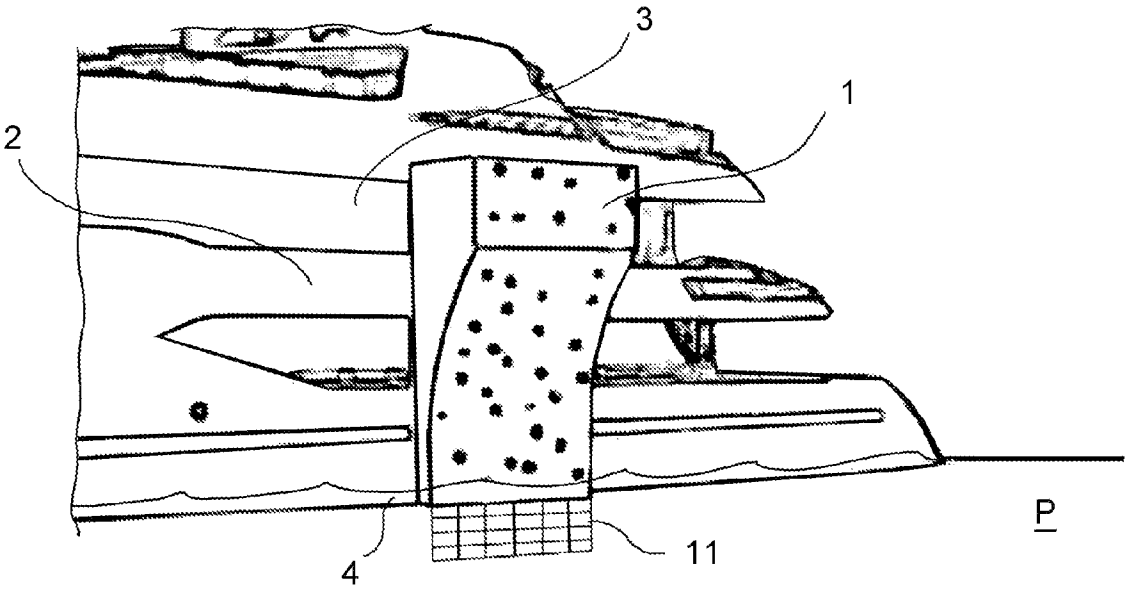

With particular reference to the FIGS. 1*a* and 1*b*, the support wall 2 of the inflatable structure 1 is the (side or rear) wall of a ship hull, whether the latter is motor-driven (as the one illustrated in the above-mentioned Figures) or sail-driven.

The inflatable structure 1 comprises at least one first main surface 5 facing the support wall 2. Such at least one first main surface 5 extends on a plane substantially vertical to the reference plane P.

The inflatable structure 1 further comprises at least one second main surface 6 opposite said at least one first main surface 5.

The inflatable structure 1 further comprises at least one first upper connecting surface 7 between the at least one first main surface 5 and the at least one second main surface 6.

Such at least one first upper connecting surface 7 is in the upper part of the inflatable structure 1, i.e., in the distal part with respect to the reference plane P.

The inflatable structure 1 further comprises at least one second lower connecting surface 8, opposite said at least one first upper connecting surface 7, between the at least one first main surface 5 and the at least one second main surface 6.

Such at least one second lower connecting surface 8 is in the lower part of the inflatable structure 1, i.e., in the part proximal to the reference plane P.

It shall be noticed that both said at least one first upper connecting surface 7 and said at least one second lower connecting surface 8 preferably extend on a plane substantially parallel to the reference plane P.

The lower portion of said at least one first main surface 5, the at least one second lower connecting surface 8 and a lower portion of said at least one second main surface 6 define a lower portion of the inflatable structure 1.

It shall be noted that the inflatable structure 1 is able to be associated to the support wall 2 so that the lower portion of the inflatable structure 1 (lower portion of said at least one first main surface 5, the at least one second lower connecting surface 8, and lower portion of said at least one second main surface 6) is underneath the reference plane P, i.e., immersed in the water. In this manner, the inflatable structure 1 is advantageously floating.

The inflatable structure 1 further comprises at least one first connecting side surface 9 between the at least one first main surface 5 and the at least one second main surface 6 and at least one second side surface 10, opposite said at least one first connecting side surface 9, between the at least one first main surface 5 and the at least one second main surface 6.

It shall be noted that both said at least one first connecting side surface 9 and said at least one second connecting side surface 10 preferably extend on a plane orthogonal to the plane represented by the support wall 2 and the reference plane P.

It is pointed out that the inflatable structure 1 generally has a first main length L1 in a direction orthogonal to the reference plane P and a second main length L2 in a direction parallel to the reference plane P.

In accordance with the embodiment of the Figures, the first main length L1 is greater than the second main length L2.

In accordance with further embodiments (not shown in the Figures), the first main length L1 can be less than or substantially the same as the second main length L2.

Furthermore, the inflatable structure 1 has a main width L3 in a direction orthogonal to the plane represented by the support wall 2 of the inflatable structure 1.

The main width L3, along a direction orthogonal to the reference plane P, may have different values.

In the embodiment of the Figures, the main width L3 of the inflatable structure 1, in a direction orthogonal to the reference plane P, has a first value in the upper part of the inflatable structure 1 and a second value, which is less than the first value, in the lower part of the inflatable structure 1. Between the first value and the second value, the main width L3 gradually decreases to pass from the first value to the second value.

In accordance with other embodiments (not shown in the Figures), the main width L3 may take the same value along the entire direction orthogonal to the reference plane P, or it may pass from a first value to a second value, in which the first value (in the upper part of the inflatable structure 1) is less than the second value (in the lower part of the inflatable structure 1) or it may pass from a value to the next one of a plurality of values, which are greater than, less than, or the like one to the other.

The inflatable structure 1 advantageously comprises means 11 for accessing the inflatable structure 1 configured to allow a person the access from the water to the inflatable structure 1.

Such means 11 for accessing are operatively connected to the lower portion of the inflatable structure 1. The means 11 for accessing extend along a plane substantially orthogonal to the reference plane P.

It is pointed out that the means 11 for accessing are advantageously underneath the reference plane P (stretch of water).

The so-configured means 11 for accessing advantageously allow a person the access to the inflatable structure 1 directly from the water without particular efforts, since the means 11 for accessing, extending along a plane substantially orthogonal to the reference plane P, represent a stable support to rest the feet and/or hands to climb onto the inflatable structure 1.

It is pointed out that the lower portion of the inflatable structure 1 comprises a first plurality of securing members E1 (described herein below) of the means 11 for accessing the inflatable structure 1.

Furthermore, in an embodiment (illustrated in the Figures), the means 11 for accessing are connected to the lower portion of the at least one second main surface 6. In this case, the first plurality of securing members E1 will be distributed on the lower portion of the at least one second main surface 6.

In accordance with another embodiment (not shown in the Figures), the means 11 for accessing can be connected to the at least one second lower connecting surface 8 in the proximity of the lower portion of the at least one second main surface 6. In such a case, the first plurality of securing members E1 will be distributed on the at least one second lower connecting surface 8 in the proximity of the lower portion of the at least one second main surface 6.

In the embodiment of the Figures, the means 11 for accessing comprise a mesh grid 11 made of a non-floating material (for example, nylon) comprising a first plurality of segments S1 distributed substantially parallel to the reference plane P, and a second plurality of segments S2 distributed substantially orthogonal to the reference plane P.

The first plurality of segments S1 and the second plurality of segments S2 form the mesh grid 11.

It is pointed out that the mesh grid 11 is preferably manufactured with one or more ropes or lines made of a non-floating material.

During the access by a person to the inflatable structure 1, the mesh grid 11 performs the function of a stepladder in which the first plurality of segments S1 mainly represents the support for the feet, while the second plurality of segments S2 mainly represents the handhold for the hands.

Again in the embodiment of the Figures, the mesh grid 11 comprises a plurality of coating members 12 (shown in the FIGS. 3-7), preferably tubes, made of a non-floating material (for example, nylon) of the first plurality of segments S1.

In more detail, each coating member of said plurality of coating members 12 is suitable to coat a segment of the first plurality of segments S1.

The plurality of coating members 12 advantageously allows the mesh grid 11, together with the mesh grid itself, already in a non-floating material, to keep an extent as much substantially orthogonal to the reference plane P as possible.

Referring back to the first plurality of securing members E1 of the means 11 for accessing the inflatable structure 1, it is pointed out that they comprise, for example, loops with rings and/or bands to allow securing, by knotting, stitching, gluing, or clamping, the means 11 for accessing.

In the embodiment of the Figures, the first plurality of securing members E1 is suitable to allow the passage therein of the free ends of part of the second plurality of segments S2 of the mesh grid 11 for a successive knotting or stitching.

Referring back to the inflatable structure 1, it further comprises a plurality of gripping members 13 distributed on the at least one second main surface 6 of the inflatable structure 1.

The plurality of gripping members 13 is configured to allow a free climbing for a person.

In fact, each gripping member 13 represents a support for the feet and a handhold for the hands while performing a free climbing, both upwardly and downwardly.

In more detail, the plurality of gripping members 94 is distributed so as to define a plurality of climbing paths. Each path of said plurality of climbing paths has a difficulty level that is different from the other ones.

For example, the plurality of climbing paths comprises four climbing paths, defined as follows:

a first path having a first difficulty level (for example, easy);

a second path having a second difficulty level (for example, intermediate);

a third path having a third difficulty level (for example, difficult);

a fourth path having a fourth difficulty level (for example, very easy, for a safety climbing).

It shall be noted that the difficulty of each climbing path is typically represented by the mutual distance between two successive gripping members 13 within the same climbing path.

In more detail, the plurality of gripping members 13 comprises different graphical effects, for example colours. Each graphical effect (colour) is representative of a climbing path with a respective difficulty level.

For example, a first sub-group of said plurality can be of a first colour (for example, green) to signal the first climbing path. A second group of said plurality can be of a second colour (for example, yellow), different from the previous one, to signal the second climbing path. A third group of said plurality can be of a third colour (for example, red), different from the previous ones, to signal the third climbing path. A fourth group of said plurality can be of a fourth colour (for example, grey), different from the previous ones, to signal the fourth climbing path.

In addition, it shall be noticed that the plurality of gripping members 13 is preferably shaped in respective geometrical shapes that are different one from the others.

For example, a first sub-group of said plurality may have a first geometrical shape (for example, a circle). A second group of said plurality may have a second geometrical shape (for example, a rectangle), different from the previous one. A third group of said plurality may have a third geometrical shape (for example, a square), different from the previous ones. A fourth group of said plurality may have a fourth geometrical shape (for example, a rhombus), different from the previous ones.

The fact that each path is identified by the graphical effect of the gripping members advantageously allows a person quickly identifying the path that is the most suitable to his/her skills both when climbing on the inflatable structure 1 and when, already being on the inflatable structure 1, he/she needs to change the climbing path during the way, for example, due to weariness.

Furthermore, in the case of an accidental or intentional fall, the fact that the inflatable structure 1 is supported, inserted, or floating on a stretch of water allows the person falling or diving into the water, considerably reducing the possibility of injuries or contusions.

Figure 9:
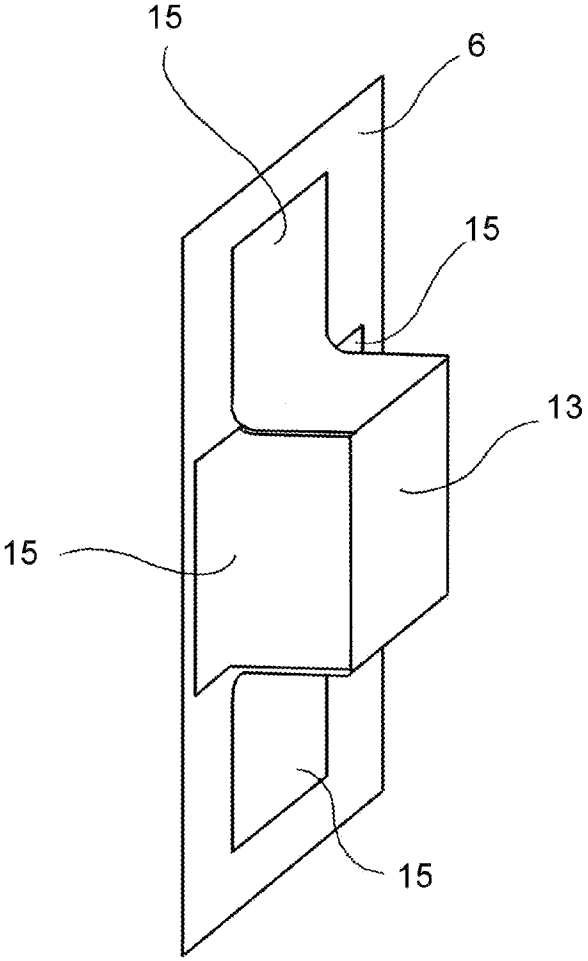
Figure 8:
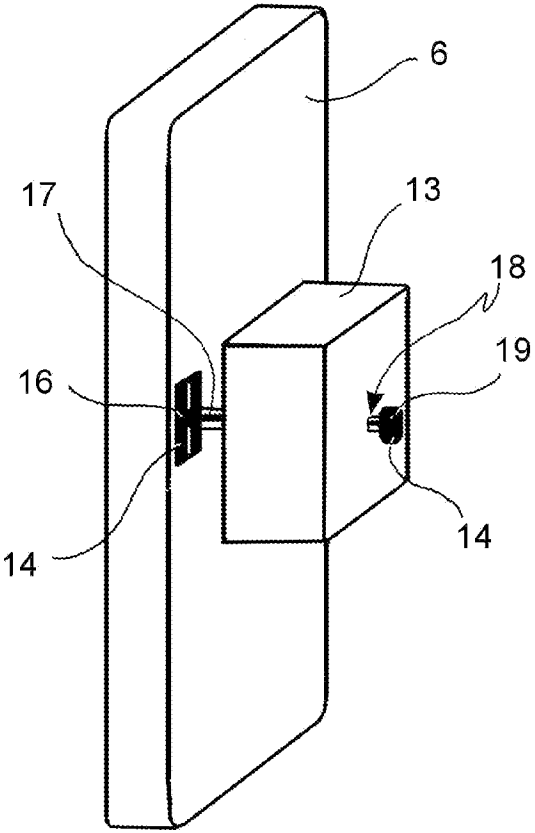

With reference to the FIGS. 8 and 9, it is pointed out that the inflatable structure 1 comprises coupling means 14 for coupling each gripping member 13 to the inflatable structure 1.

With reference to FIG. 9, the coupling means 14 of the gripping member 13 comprise glue and/or seams (not visible in the Figure).

Particularly, the gripping member 13 comprises a plurality of free ends 15 glued and/or stitched on the at least one second main surface 6 of the inflatable structure 1.

With reference to FIG. 8, the coupling means 14 of the gripping member 13 comprise a perforated plate 16 associated (for example, glued) to the at least one second main surface 6, and a coupling member 17 (for example, a screw) suitable to be inserted into a through hole 18 of the gripping member 13. The coupling member 17 has a first end suitable to engage with the perforated plate 16, for example by screwing or by snap-fitting, and a second end suitable to engage, by screwing or by snap-fitting, with a closing member 19 of the coupling means 14, suitable to abut against the gripping member 13 in order to keep it secured to the inflatable structure 1.

The coupling means 14 of the embodiment of FIG. 8 allow a quick replacement of the gripping member 13, which may be easily replaced, both in the case of a breakage and/or repair, and in the case that it is necessary to replace the gripping member with another gripping member having, for example, a different shape or graphical effect, in order to change or provide different climbing paths on the at least one second main surface 6.

With reference generally to the inflatable structure 1 of the Figures, it further comprises a plurality of inflatable members 20, for example in a tubular shape, which are operatively connected to the at least one first main surface 5.

The plurality of inflatable members 20 is interposed between the at least one first main surface 5 and the support wall 2 of the inflatable structure 1.

The plurality of inflatable members 20 is connected to the at least one first main surface 5 by knotted or stitched ropes, with an end, on further securing members E1' arranged on the sides of each inflatable member 20, and, with the other end, on further securing members of a second plurality E2 distributed on said at least one first side wall 9 and on said at least one second side wall 10.

The further securing members E1' and the second plurality of securing members E2 are completely similar to the securing members of the first plurality of securing members E1, described above.

It shall be noted that the plurality of inflatable members 20 advantageously allows avoiding sudden impacts, during the normal floating in water, of the inflatable structure 1 against the support wall 2, which could mainly damage the inflatable structure 1.

With particular reference to FIG. 1, the inflatable structure 1 further comprises a third plurality of securing members E3 of the inflatable structure 1 to the support wall 2.

The third plurality of securing members E3 is distributed on the upper part of said at least one second main surface 6 of the inflatable structure 1.

In an alternative embodiment, the third plurality of securing members E3 can be distributed on the at least one first upper connecting surface 7 of the inflatable structure 1.

The third plurality of securing members E3 is configured to receive ends of ropes or lines, knotted or stitched thereon, the opposite ends of which are secured to the member for securing the inflatable structure 1, which are present on top of the first portion 3 of such support wall 2, introduced above, but not illustrated.

Figure 2:
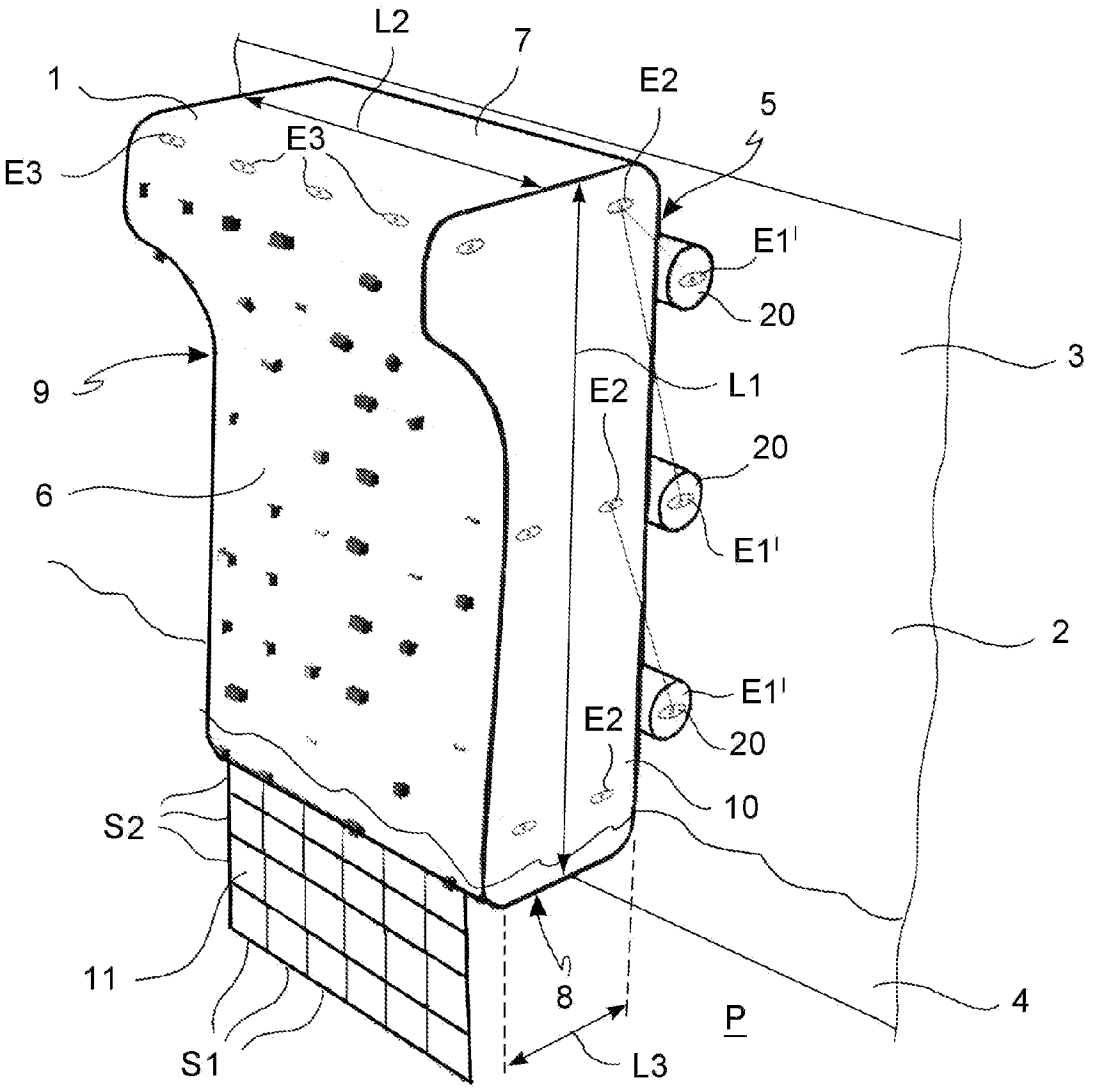
FIG. 2 schematically illustrates a perspective view of an inflatable structure for physical exercise in water according to an embodiment of the invention.
Figure 4:
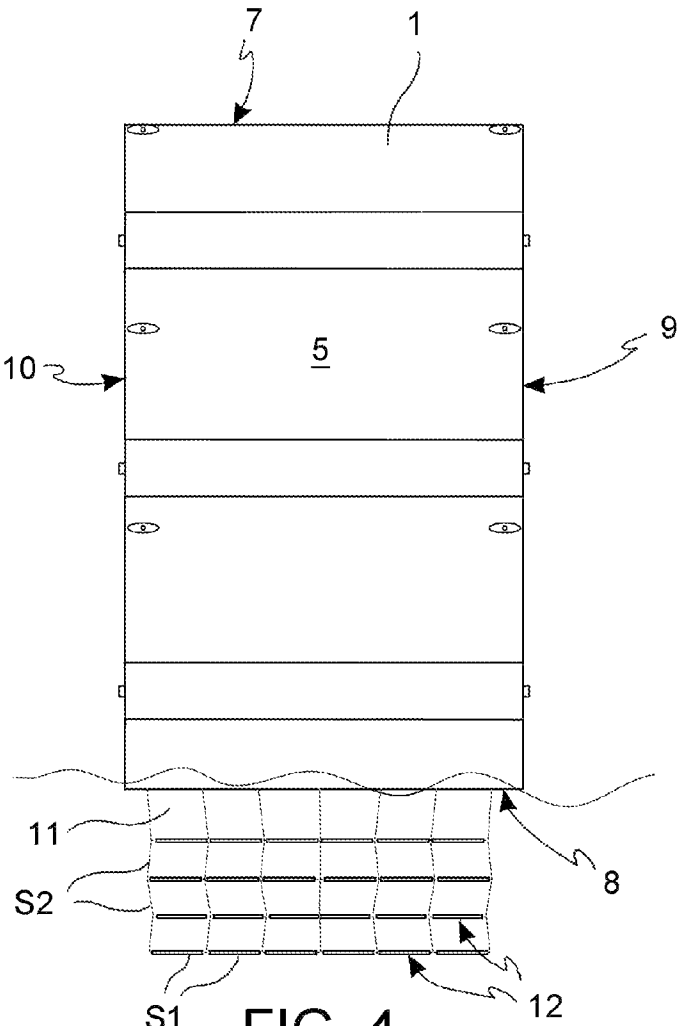
FIGS. 3 and 4 illustrate a front view and a rear view of the inflatable structure of FIG. 2, respectively.
Figure 3:
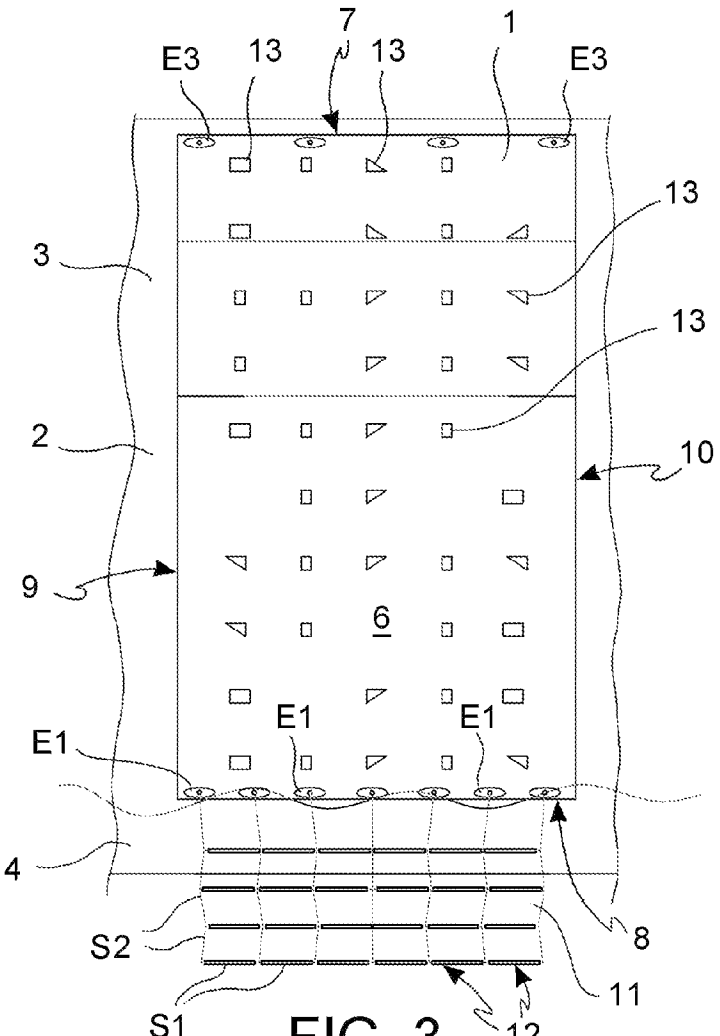
Figure 5:
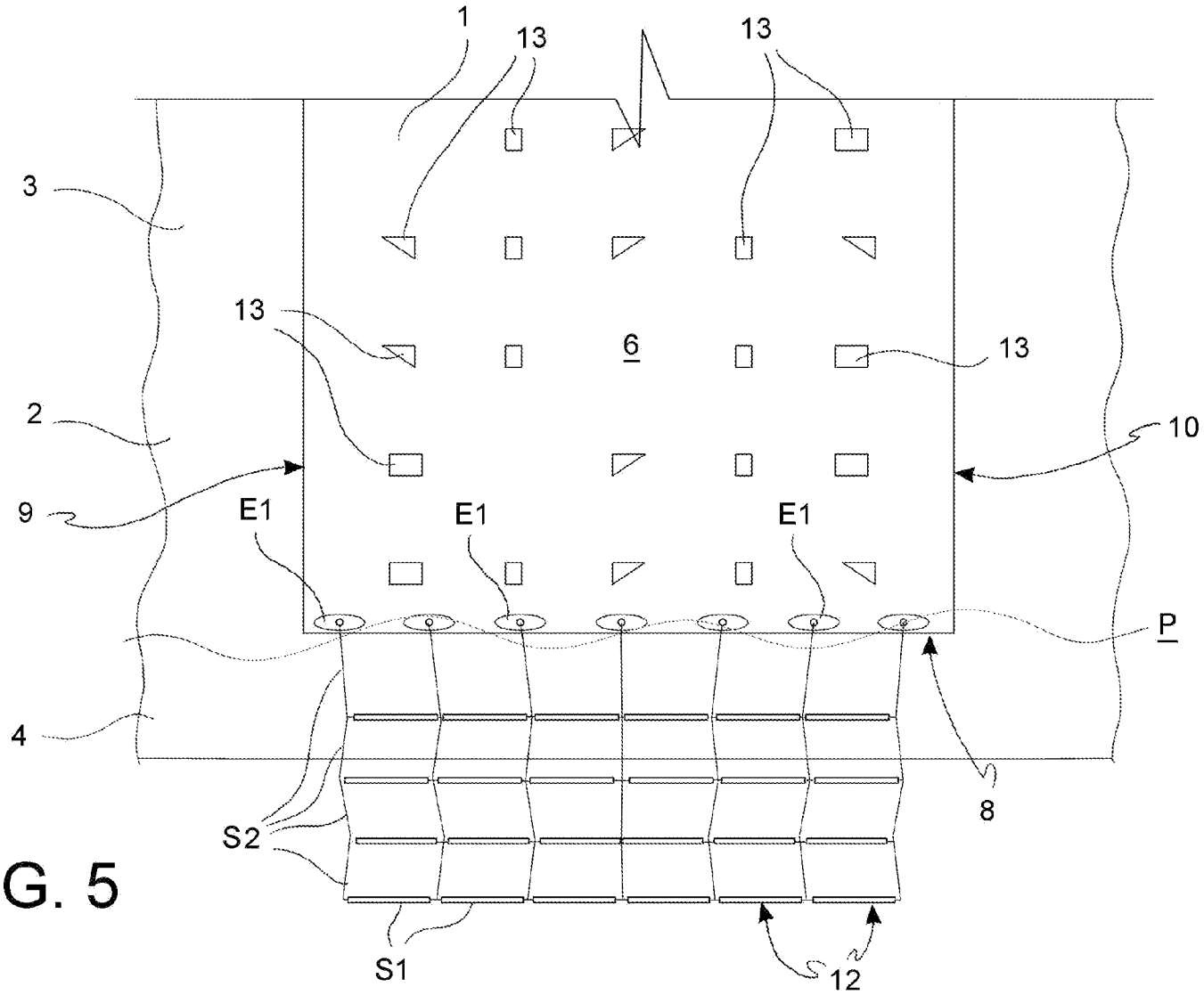
FIG. 5 schematically illustrates an enlargement of a portion of the front view of FIG. 3.
Figure 7:
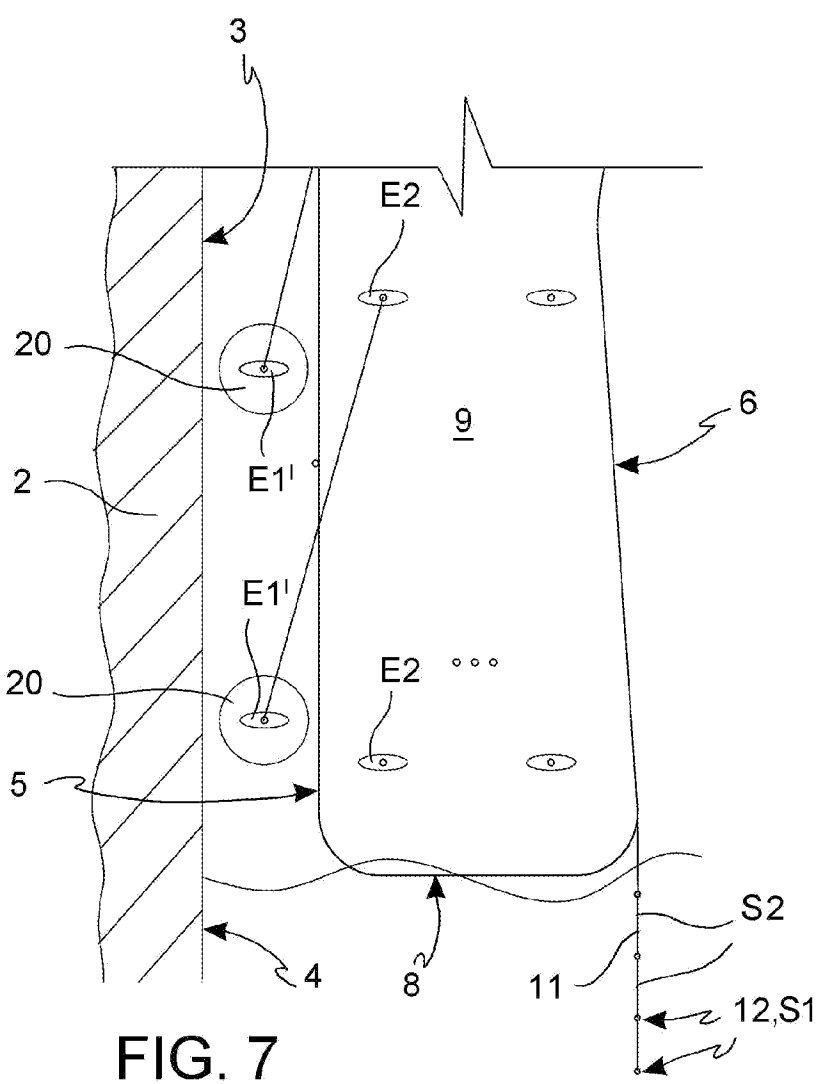
FIG. 7 illustrates an enlargement of a portion of the side view of FIG. 6, and FIGS. 8 and 9 respectively illustrate elements of an inflatable structure for physical exercise in water, according to embodiments of the present invention.
Figure 6:
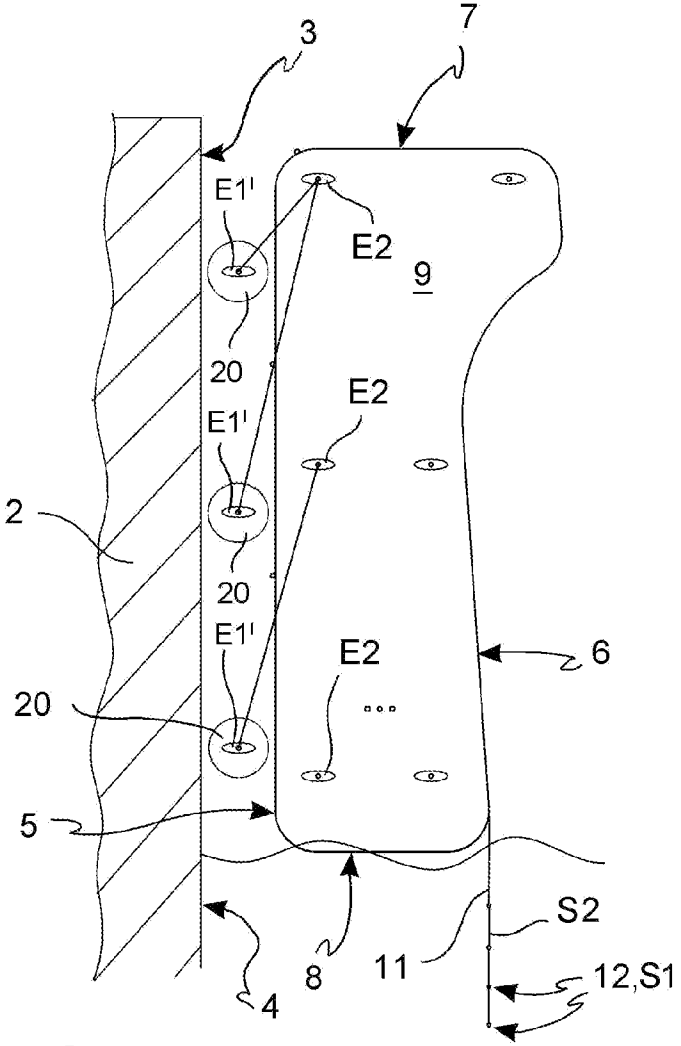
FIG. 6 schematically illustrates a side view of the inflatable structure for physical exercise in water of FIG. 2.

With reference now to the FIGS. 1*a*, 1*b*, and 2, an example of operation and use of the inflatable structure 1 for physical exercise in water is described.

The inflatable structure 1 is secured to the support wall 2, for example the (side or rear) wall of a motor-driven ship (FIGS. 1*a* and 1*b*).

The plurality of inflatable members 20 interposed between the at least one first main surface 5 and the support wall 2 avoid that, during the normal floating of the ship and/or the inflatable structure 1, the inflatable structure 1 can be damaged by impacting the support wall 2.

A person that is already in the water easily accesses the inflatable structure 1 through the access means 11 (mesh grid) arranged underneath the water surface and having such a weight that, having members (ropes or lines and/or coating members) made of a non-floating material, imparts to the access means 11 such a rigidity as to keep an extension substantially orthogonal to the reference plane P.

Once the person has accessed the inflatable structure, he/she can start climbing upwardly, following one of the climbing paths signaled by the configuration (shape) and/or the graphical effect (colour) of the plurality of gripping members 13 distributed on said at least one second main surface 6.

Once he/she has reached the upper part of the inflatable structure 1, the person can get in on board of the ship, or he/she can take a climbing path in the opposite direction in order to descend. In addition, the person can dive, by choice, from the upper part of the inflatable structure 1 or he/she can dive during the upwardly or downwardly climbing.

As it can be noticed, the object of the invention is achieved, since the inflatable structure has different advantages compared to those described with reference to the prior art.

In fact, the presence of means for accessing the inflatable structure, extending along a plane substantially orthogonal to the reference plane P (stretch of water), allow a convenient and easy access from the water.

Other advantages, as already indicated above, are due to the presence of the plurality of inflatable members between the inflatable structure and the support wall of the inflatable structure (a reduction effect of the impacts of the inflatable structure on the support wall), the presence of gripping members comprising different graphical effects—colour—(signaling of a climbing path difficulty), the presence of particular coupling means of the gripping members to the inflatable structure (replacement easiness—interchangeability).

Furthermore, the inflatable structure is floating, since the lower portion can be located and/or it can be partially introduced in the stretch of water.

To the embodiments of the inflatable structure described above, those of ordinary skill in the art, in order to meet contingent needs, will be able to make modifications, adaptations, and replacements of elements with functionally equivalent other ones, without departing from the scope of the following claims. Each of the characteristics described as belonging to a possible embodiment can be implemented independently from the other embodiments described.

The invention claimed is:

1. An inflatable structure for physical exercise in water, said inflatable structure being able to be associated to a support wall of said inflatable structure, the support wall extending along a plane substantially orthogonal to a reference plane substantially corresponding to a surface of water, the inflatable structure comprising:

at least one first main surface facing the support wall, said at least one first main surface extending on a plane substantially orthogonal to the reference plane;

at least one second main surface opposite said at least one first main surface;

at least one first upper connecting surface between the at least one first main surface and the at least one second main surface, said at least one first upper connecting surface being located in an upper part of the inflatable structure;

at least one second lower connecting surface, opposite said at least one first upper connecting surface, between the at least one first main surface and the at least one second main surface, said at least one second lower connecting surface being in a lower part of the inflatable structure, a lower portion of said at least one first main surface, the at least one second lower connecting surface, and a lower portion of said at least one second main surface defining a lower portion of the inflatable structure, the inflatable structure being able to be associated to the support wall so that a lower portion of the inflatable structure is underneath the reference plane, the inflatable structure being characterized in that it comprises an access device for the inflatable structure, which is configured to allow a person the access from the water to the inflatable structure, said access device being operatively connected to the lower portion of the inflatable structure, said access device extending along a plane substantially orthogonal to the reference plane.

2. The inflatable structure according to claim 1, wherein the access device comprises: a mesh grid of a non-floating material, comprising a first plurality of segments distributed substantially parallel to the reference plane, and a second plurality of segments distributed substantially orthogonal to the reference plane.

3. The inflatable structure according to claim 2, wherein the mesh grid comprises a plurality of coating members of the first plurality of segments, said plurality of coating members being made of a non-floating material.

4. The inflatable structure according to claim 1, further comprising a plurality of gripping members distributed on the at least one second main surface, said plurality of gripping members being configured to allow a free climbing for a person.

5. The inflatable structure according to claim 4, wherein the plurality of gripping members is configured to define a plurality of climbing paths, each path of said plurality of climbing paths having a difficulty level that is different from the other ones.

6. The inflatable structure according to claim 5, wherein the plurality of gripping members comprises different graphical effects, each graphical effect being representative of a climbing path with a respective difficulty level.

7. The inflatable structure according to claim 6, wherein the plurality of gripping members is shaped in respective different geometrical shapes.

8. The inflatable structure according to claim 4, comprising coupler for coupling each of gripping members to the inflatable structure.

9. The inflatable structure according to claim 8, wherein the coupler comprises a perforated plate associated to said at least one second main surface, and a coupling member suitable to be inserted into a through hole of the gripping member, the coupling member having a first end suitable to engage with the perforated plate, and a second end suitable to engage with a closing member of the coupler suitable to abut against the gripping member in order to keep it secured to the inflatable structure.

10. The inflatable structure according to claim 1, further comprising a plurality of inflatable members that are operatively connected to said at least one first main surface, the plurality of inflatable members being interposed between said at least one first main surface and the support wall of the inflatable structure.

* * * * *